US006739971B2

(12) United States Patent
Devaull

(10) Patent No.: US 6,739,971 B2
(45) Date of Patent: May 25, 2004

(54) BONUS ACCUMULATOR FOR CHANCE GAME

(75) Inventor: John W. Devaull, Absecon, NJ (US)

(73) Assignee: WMS Gaming Inc., Waukegan, IL (US)

( * ) Notice: Subject to any disclaimer, the term of this patent is extended or adjusted under 35 U.S.C. 154(b) by 399 days.

(21) Appl. No.: 09/833,105

(22) Filed: Apr. 11, 2001

(65) Prior Publication Data

US 2002/0151346 A1 Oct. 17, 2002

(51) Int. Cl.[7] ..... A63F 9/24
(52) U.S. Cl. ..... 463/20
(58) Field of Search ..... 463/1, 9–13, 16–20, 463/25–26, 29–30, 36, 40–43; 273/292–293, 143 R, 309, 236–237; 340/323 R; 700/91–93

(56) References Cited

U.S. PATENT DOCUMENTS 6,120,031 A 9/2000 Adams ..... 273/292
6,190,255 B1 2/2001 Thomas et al. ..... 463/20

FOREIGN PATENT DOCUMENTS

EP 281402 A2 * 9/1988
GB 2222712 * 3/1990

OTHER PUBLICATIONS

Product Sheet for MONOPOLY ® CHAIRMAN OF THE BOARD ™ (Reel), WMS Gaming Inc., 2 pages (1999).
Prodcut Sheet for BOOM™ VIDEO*, WMS Gaming Inc., 1 page (1998).
Product Sheet for XFACTOR™, WMS Gaming Inc., 2 pages (1997).
Brochure for MULTI–PAY™ PLUS, WMS Gaming Inc., 4 pages (1997).

* cited by examiner

*Primary Examiner*—Mark Sager
(74) *Attorney, Agent, or Firm*—Jenkens & Gilchrist

(57) ABSTRACT

A game of chance comprises a game play engine with a bonus accumulator. In response to a wager, the game play engine is executed to randomly select an outcome from a plurality of possible outcomes. The bonus accumulator accumulates bonus elements based on predetermined criteria. The bonus elements are redeemable by a player for an award during any game play cycle defined as starting with the wager and ending with a succeeding wager triggering the game play engine.

27 Claims, 3 Drawing Sheets

3/3

BONUS ACCUMULATOR FOR CHANCE GAME

FIELD OF THE INVENTION

The present invention relates generally to games of chance and, more particularly, to a game of chance including an "on-demand" bonus accumulator that accumulates bonus elements based on predetermined criteria and allows the accumulated bonus elements to be redeemed for play credits or game features during any game play cycle.

BACKGROUND OF THE INVENTION

Gaming machines, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are likely to be attracted to the most entertaining and exciting of the machines. Consequently, shrewd operators strive to employ the most entertaining and exciting machines available because such machines attract frequent play and, hence, increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

A feature employed in some prior games is a bonus accumulator that accumulates bonus elements based on predetermined criteria. For example, a prior game entitled "Piggy Bankin'" includes three symbol-bearing reels and a bonus accumulator in the form of a piggy bank. In response to a wager, the reels are spun and stopped to place symbols on the reels in visual association with a pay line. For each spin resulting in three blanks along the pay line, the piggy bank is incremented by the wager amount. For a spin resulting in a "Break the Bank" symbol on the third reel, the player is awarded the accumulated total in the piggy bank. In another example, a prior game entitled "Boom" includes a plurality of symbol-bearing reels and a bonus accumulator in the form of a firecracker register. In response to a wager, the reels are spun and stopped to place symbols on the reels in visual association with multiple pay lines. A firecracker mark is added to the firecracker register for every 25 credits wagered. Each firecracker mark is worth one credit. The player is awarded a firecracker bonus equal to the number of firecracker marks in the firecracker register when either (1) the firecracker register reaches fifty firecracker marks, or (2) a spin results in two "wild match" symbols anywhere on the display.

Although such prior games are generally entertaining, the bonus accumulator suffers from a couple shortcomings. First, to redeem any bonus elements accumulated in the bonus accumulator, a player must continue to wager and play the game until accomplishing an infrequent predetermined event that triggers the redemption of bonus elements. If the player must walk away from the gaming machine for some reason, e.g., the player runs out of money, the player may be frustrated by his/her forfeiture of the bonus elements which now remain in the bonus accumulator for redemption by a subsequent player. Second, because players may walk away before redeeming the accumulated bonus elements, people looking to play a game with a bonus accumulator may scout for and hover around those machines with greater bonus elements in the bonus accumulator.

A need, therefore, exists for a bonus accumulator that overcomes the above-noted shortcomings of the bonus accumulator employed in prior games.

SUMMARY OF THE INVENTION

A game of chance comprises a game play engine with a bonus accumulator. In response to a wager, the game play engine is executed to randomly select an outcome from a plurality of possible outcomes. The bonus accumulator accumulates bonus elements based on predetermined criteria. The bonus elements are redeemable by a player for an award during any game play cycle defined as starting with the wager and ending with a succeeding wager triggering the game play engine.

BRIEF DESCRIPTION OF THE DRAWINGS

The foregoing and other advantages of the invention will become apparent upon reading the following detailed description and upon reference to the drawings.

Figure 1:
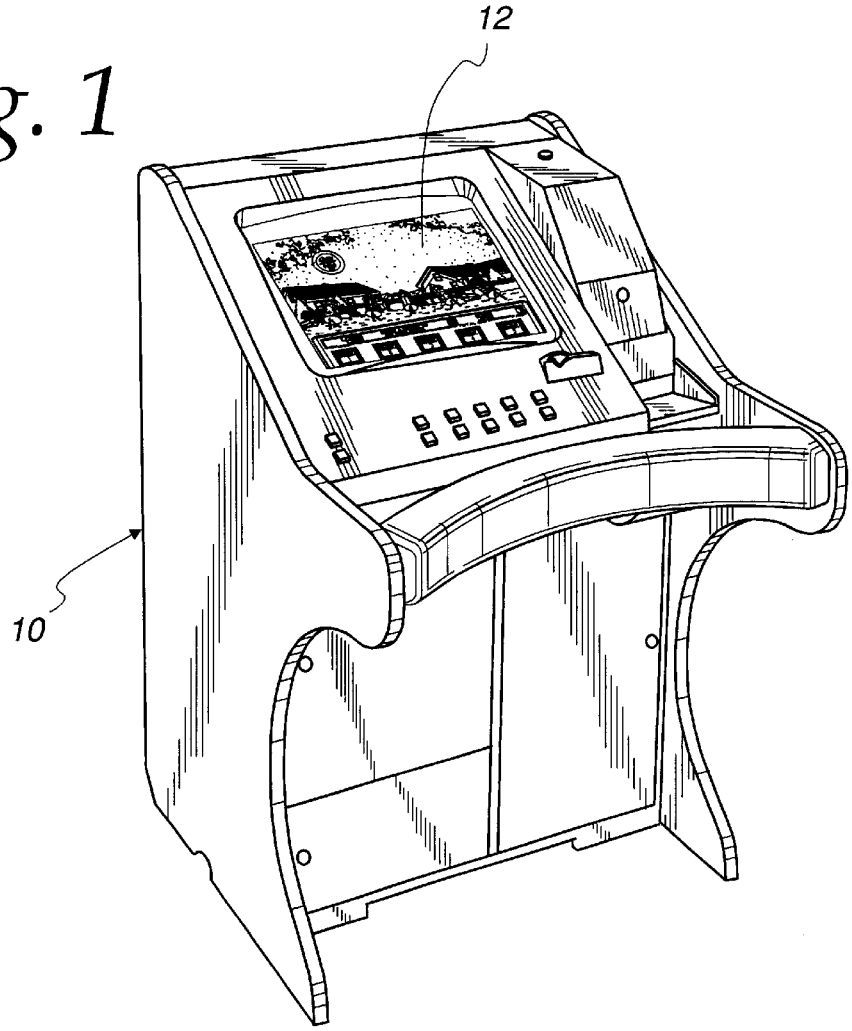
FIG. 1 is a perspective view of a gaming machine embodying the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Turning now to the drawings and referring initially to FIG. 1, there is depicted a gaming machine 10 executing a game of chance that may be used to implement an "on-demand" bonus accumulator according to the present invention. The gaming machine 10 includes a visual display 12 preferably in the form of a dot matrix, CRT, LED, LCD, electro-luminescent, or other type of video display known in the art. The display 12 preferably includes a touch screen overlaying the monitor. In the illustrated embodiment, the gaming machine 10 is a "slant-top" version in which the display 12 is slanted at about a thirty-degree angle toward the player of the gaming machine 10. Alternatively, the gaming machine may be an "upright" version in which the display 12 is oriented vertically relative to the player.

In one embodiment, the gaming machine 10 is operable to play a game of chance entitled BOOM having a fireworks theme. The BOOM game is similar to the 1998 game of the same title by the instant assignee, except that it has been enhanced to include the "on-demand" bonus accumulator of the present invention. The enhanced BOOM game features a basic slot game with five simulated spinning reels and a bonus game triggered by a start-bonus outcome in the basic game. It will be appreciated, however, that the gaming machine 10 may be implemented with themes other than fireworks.

Figure 2:
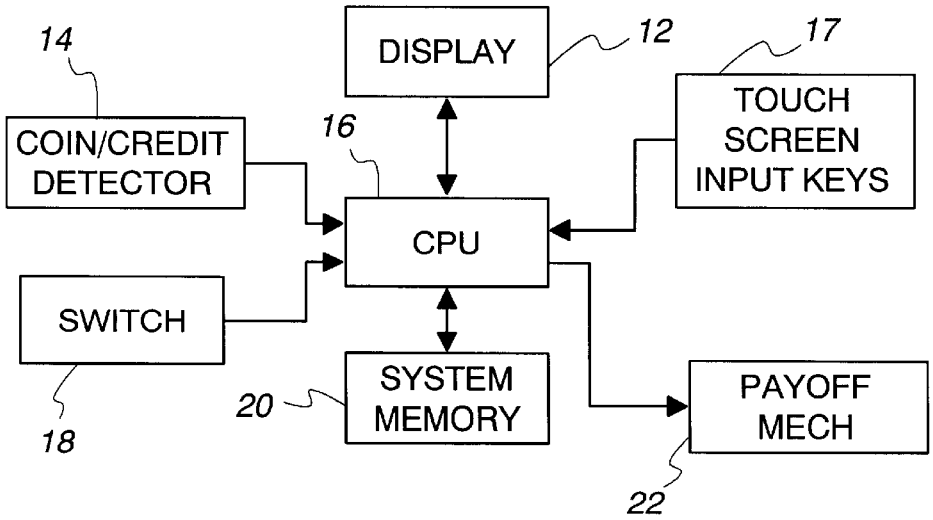
FIG. 2 is a block diagram of a control system suitable for operating the gaming machine.

FIG. 2 is a block diagram of a control system suitable for operating the gaming machine 10. Coin/credit detector 14 signals a central processing unit ("CPU") 16 when a player has inserted a number of coins or played a number of credits. Then, the CPU 16 operates to execute a game program that causes the display 12 to display the basic game that includes simulated symbol-bearing reels. The player may select the number of pay lines to play and the amount to wager via touch screen input keys 17. The basic game commences in response to the player activating a switch 18 (e.g., by pulling a lever or pushing a button), causing the CPU 16 to set the reels in motion, randomly select a game outcome, and then stop the reels to display symbols corresponding to the pre-selected game outcome. In one embodiment, one of the basic game outcomes causes the CPU 16 to enter a bonus mode whereby the display 12 shows a bonus game with animation of fireworks.

A system memory 20 stores control software, operational instructions, and data associated with the gaming machine 10. In one embodiment, the memory 20 comprises a separate read only memory (ROM) and battery-backed random access memory (RAM). It will be appreciated, however, that the system memory 20 may be implemented on any of several alternative types of memory structures or may be implemented on a single memory structure. A payoff mechanism 22 is operable in response to instructions from the CPU 16 to award a payoff of coins or credits to the player in response to certain winning outcomes which may occur in the basic or bonus games. The payoff amounts corresponding to certain combinations of symbols in the basic game are predetermined according to a pay table stored in system memory 20. The payoff amounts corresponding to certain outcomes of the bonus game are also stored in system memory 20.

Figure 3:
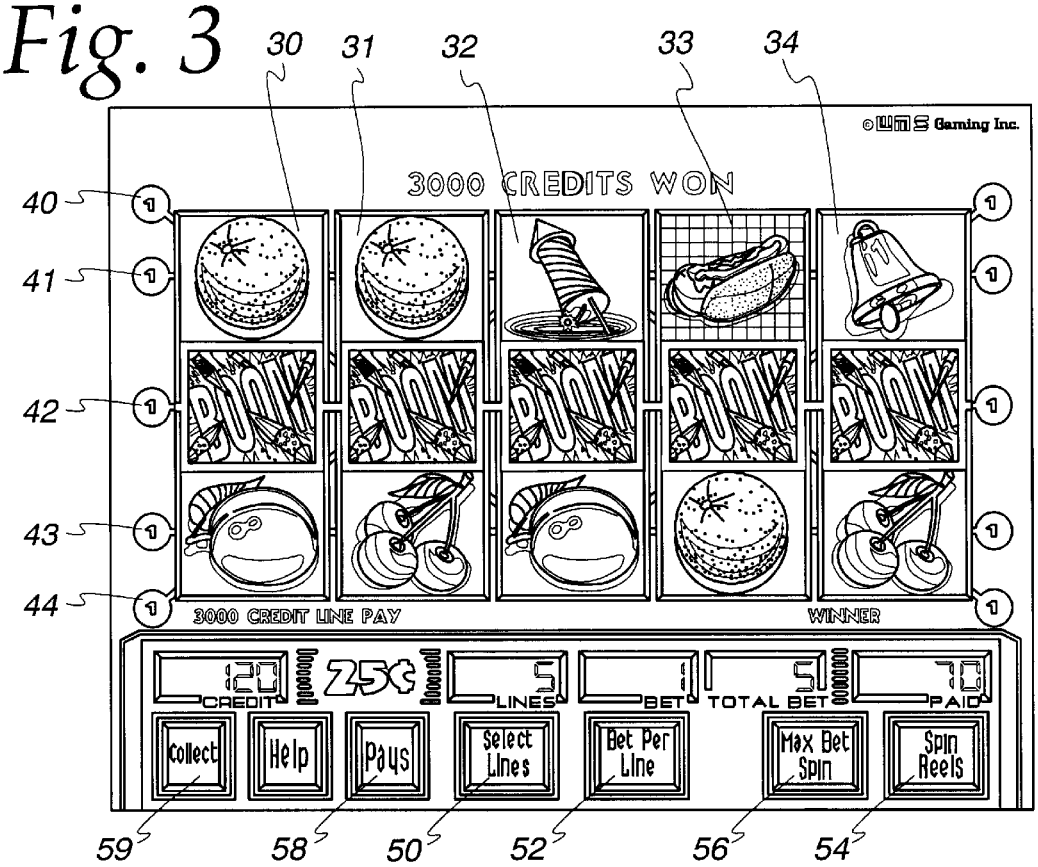
FIG. 3 is a display screen capture of a basic slot game executed on the gaming machine and showing a start-bonus combination for triggering a bonus game.

As shown in FIG. 3, the BOOM basic game is implemented on the display 12 on five video simulated spinning reels 30–34 with five pay lines 40–44. Each of the pay lines 40–44 extends through one symbol on each of the five reels 30–34. Generally, game play is initiated by inserting a number of coins or playing a number of credits, causing the CPU 16 (FIG. 2) to activate a number of pay lines corresponding to the number of coins or credits played. In one embodiment, the player selects the number of pay lines (between one and five) to play by pressing a "Select Lines" key 50 on the video display 12. The player then chooses the number of coins or credits to bet on the selected pay lines by pressing the "Bet Per Line" key 52.

After activation of the pay lines, the reels 30-34 may be set in motion by touching the "Spin Reels" key 54 or, if the player wishes to bet the maximum amount per line, by using the "Max Bet Spin" key 56 on the video display 12. Alternatively, other mechanisms such as, for example, a lever or push button may be used to set the reels in motion. The CPU 16 uses a random number generator to select a game outcome (e.g., "basic" game outcome) corresponding to a particular set of reel "stop positions." The CPU 16 then causes each of the video reels 30–34 to stop at the appropriate stop position. Video symbols are displayed on the reels 30-34 to graphically illustrate the reel stop positions and indicate whether the stop positions of the reels represent a winning game outcome.

Winning basic game outcomes (e.g., symbol combinations resulting in payment of coins or credits) are identifiable to the player by a pay table. In one embodiment, the pay table is affixed to the machine 10 and/or displayed by the video display 12 in response to a command by the player (e.g., by pressing the "Pay Table" button 58). A winning basic game outcome occurs when the symbols appearing on the reels 30–34 along an active pay line correspond to one of the winning combinations on the pay table. A winning combination, for example, could be three or more ORANGE symbols along an active pay line, where the award is greater as the number of ORANGE symbols along the active pay line increases. If the displayed symbols stop in a winning combination, the game credits the player an amount corresponding to the award in the pay table for that combination multiplied by the amount of credits bet on the winning pay line. The player may collect the amount of accumulated credits by pressing the "Collect" button 59. In one implementation, the winning combinations start from the first reel 30 (left to right) and span adjacent reels. In an alternative implementation, the winning combinations start from either the first reel 30 (left to right) or the fifth reel 34 (right to left) and span adjacent reels.

Included among the plurality of basic game outcomes is a start-bonus outcome for triggering play of a bonus game. A start-bonus outcome may be defined in any number of ways For example, a start-bonus outcome occurs when a special start-bonus symbol or a special combination of symbols appears on one or more of the reels 30–34. The start-bonus outcome may require the combination of symbols to appear along an active pay line or, alternatively, may require that the combination of symbols appear anywhere on the display regardless of whether the symbols are along an active pay line. The appearance of a start-bonus outcome causes the CPU to shift operation from the basic game to the bonus game.

Figure 4:
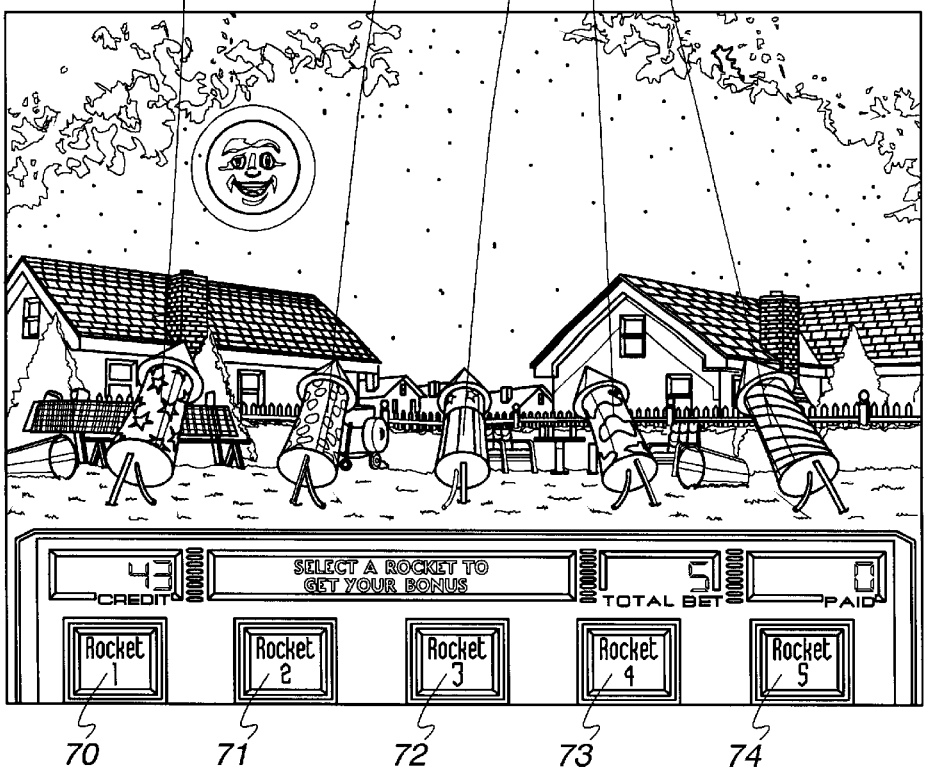
FIG. 4 is a display screen capture of the bonus game.

Three or more BOOM symbols along an active pay line trigger a bonus game with animation of fireworks. In FIG. 3, five BOOM symbols are depicted along the middle horizontal pay line 42. Referring to FIG. 4, in response to triggering the bonus game, the display 12 depicts five rockets 60–64 and prompts the player to select one of the rockets via the corresponding touch keys 70–74 to get a bonus. The bonus is accompanied by an animation of fireworks in which the selected rocket is launched and exploded.

Figure 5:
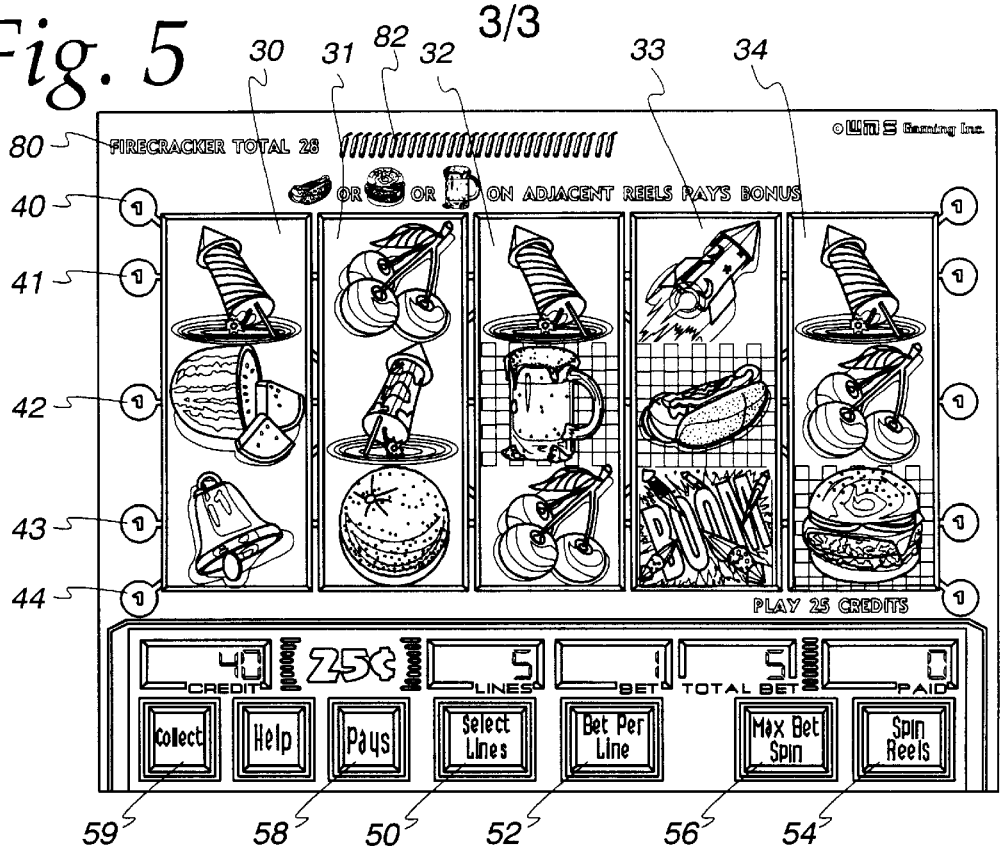
FIG. 5 is a display screen capture of the basic slot game showing a bonus accumulator in the form of a firecracker register.

Referring to FIG. 5, in accordance with the present invention, the enhanced BOOM game includes an "on-demand" bonus accumulator in the form of a firecracker register 80. In a first embodiment, a bonus element in the form of a firecracker mark 82 is added to the firecracker register 80 for every 25 credits wagered. In a second embodiment, a firecracker mark 82 is added to the firecracker register 80 for every winning spin resulting in a payout. In a third embodiment, a firecracker mark 82 is added to the firecracker register 80 for every winning spin resulting in a payout and a CANDY CANE ROCKET symbol on a winning pay line. In a fourth embodiment, a firecracker mark 82 is added to the firecracker register 80 for every spin that triggers the fireworks bonus game. In a fifth embodiment, a firecracker mark 82 is added to the firecracker register 80 for every losing spin resulting in no payout. The above embodiments can be combined such that a firecracker mark 82 is added to the firecracker register 80 in response to the occurrence of any of multiple events.

As discussed above, in the original BOOM game, the player was awarded a firecracker bonus equal to the number of firecracker marks in the firecracker register when either (1) the firecracker register reached fifty firecracker marks, or (2) a spin resulted in two "wild match" symbols anywhere on the display. The above prerequisites for redeeming the firecracker marks for a bonus could lead to frustration of players forced to walk away from the gaming machine before redemption and a "vulture" effect whereby new players hover around those machines with larger numbers of firecracker marks in the firecracker register.

The enhanced BOOM game overcomes these problems by allowing a player to redeem the firecracker marks 82 in the firecracker register 80 for an award during any game play cycle. A game play cycle may be defined as starting with one wager triggering one spin of the reels and ending with a succeeding wager triggering another spin of the reels. In one embodiment, the player must redeem all of the firecracker marks 82 in the firecracker register 80 at one time. In an alternative embodiment, the player may redeem a selected number of the firecracker marks 82 at one time. The award for which the firecracker marks 82 are redeemed may be in the form of credits or a game feature.

Figure 6:
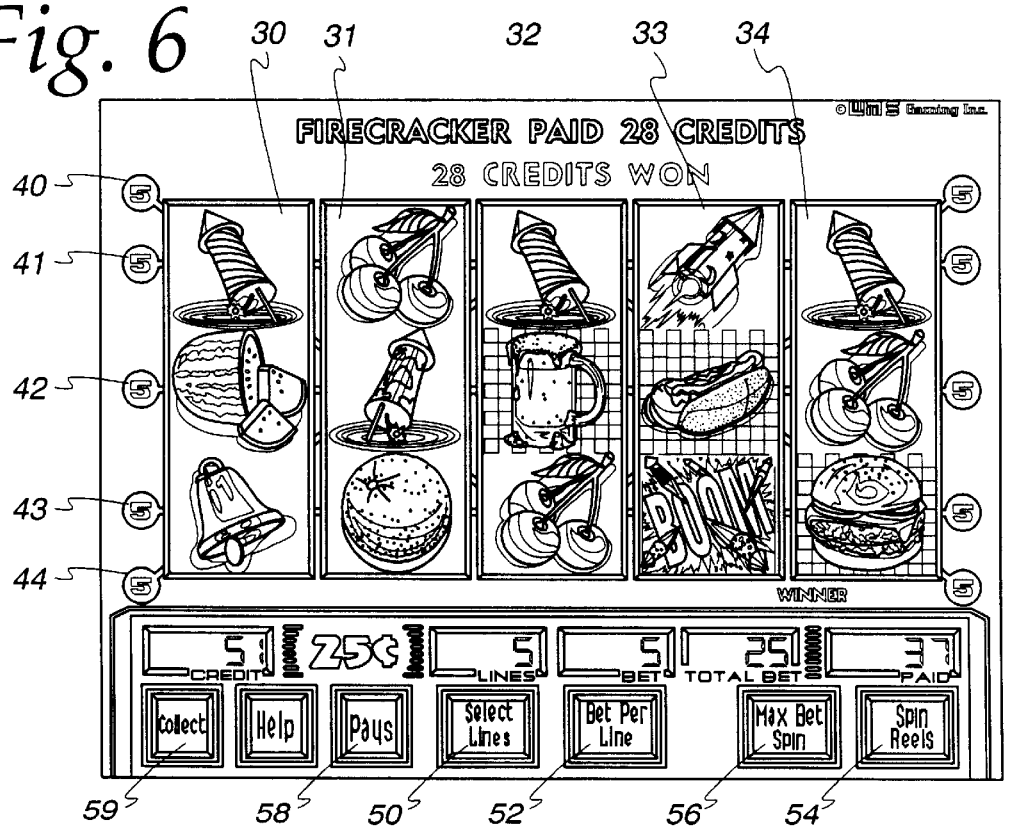
FIG. 6 is a display screen capture of the basic slot game showing firecracker marks in the firecracker register having been redeemed for credits.

In a first embodiment, the award is in the form of credits. Each firecracker mark 82 is worth a predetermined number of credits, such as one credit. In FIG. 6, for example, the 28 firecracker marks 82 that were in the firecracker register 80 in FIG. 5 have been redeemed for 28 credits.

In a second embodiment, the award is in the form of free spins of the reels 30-34. The number of free spins corresponds to the number of firecracker marks 82 being redeemed. Instead of a slot game, the game of chance executed on the gaming machine may be poker, blackjack, roulette, keno, bingo, or the like. In this case, the award is in the form of free plays of the game.

In a third embodiment, if the game is poker, the award may be in the form of one or more wild cards in the poker game. The number of wild cards corresponds to the number of bonus elements (e.g., firecracker marks 82) being redeemed. The game may be designed to allow such redemption before any playing cards are revealed to the player, after the cards are revealed but prior to the draw in draw poker, or after the draw.

In a fourth embodiment, the award is in the form of free plays of the bonus game depicted in FIG. 4. The number of free plays of the bonus game corresponds to the number of firecracker marks 82 being redeemed. Of course, in order for the game to maintain a payback percentage under 100 percent and remain profitable to the operator, the probability of earning a bonus element (e.g., firecracker mark 82) and/or the average number of credits awarded by the bonus game may need to be reduced.

In a fifth embodiment, the award is in the form of credits or a game feature depending on the number of firecracker marks 82 in the firecracker register 80. For example, to trigger the game feature, the game may require the player to redeem fifty firecracker marks 82. That is, the threshold for redeeming the firecracker marks 82 for the game feature is fifty firecracker marks. If the player wishes to redeem the firecracker marks 82 prior to accumulating fifty such marks 82 in the firecracker register 80, however, the game may instead provide an award in the form of credits. The number of awarded credits may be prorated based on the average number of credits awarded by the game feature and the number of redeemed firecracker marks 82. For example, if the average number of credits awarded by the game feature is 300 credits but the player wishes to redeem 25 firecracker marks 82 instead of waiting for fifty such marks 82 to accumulate in the firecracker register 80, the game may award 150 credits (=300×25/50) for the player's redemption of 25 firecracker marks 82.

In a sixth embodiment, the award is graduated such that the greater the number of firecracker marks 82 in the firecracker register 80, the greater the redemption value of each mark. For example, if the award is in the form of credits, 10–19 firecracker marks may be redeemed at a ratio of one credit per mark, 20–29 firecracker marks may be redeemed at a ratio of two credits per mark, 30–39 firecracker marks may be redeemed at a ratio of three credits per mark, and so on. The graduated award scale acts as an incentive for players to stay at the gaming machine and earn sufficient firecracker marks 82 to reach higher levels in the graduated award scale. At the same time, however, the player is not severely penalized for early redemption.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A game of chance, comprising a game play engine with a bonus accumulator, in response to a wager, the game play engine being executed to randomly select an outcome from a plurality of possible outcomes, the bonus accumulator accumulating a number "N" of bonus elements based on predetermined criteria where the number "N" is greater than zero, in response to the bonus elements being any number "N", the bonus elements being redeemable on a demand by a player for an award during any game play cycle defined as starting with the wager and ending with a succeeding wager triggering the game play engine.

2. The game of claim 1, wherein the award includes game credits.

3. The game of claim 2, wherein each bonus element is worth one credit.

4. The game of claim 1, wherein the award includes a game feature.

5. The game of claim 4, wherein the game play engine executes a slot game including a plurality of symbol-bearing reels that are rotated and stopped to place symbols on the reels in visual association with a display area, the game feature being one or more free spins of the reels.

6. The game of claim 5, wherein the number of free spins of the reels is determined by the number "N" of bonus elements redeemed.

7. The game of claim 4, wherein the game feature includes one or more free plays of the game.

8. The game of claim 7, wherein the number of free plays is determined by the number "N" of bonus elements redeemed.

9. The game of claim 4, wherein the game play engine executes a poker game, the game feature being one or more wild cards in the poker game.

10. The game of claim 1, wherein each bonus element has an expected redemption value, the expected redemption value being greater if the number "N" of bonus elements in the bonus accumulator reaches a predetermined threshold.

11. The game of claim 1, wherein the bonus accumulator accumulates the bonus elements based on the selection of a special outcome from the plurality of possible outcomes.

12. The game of claim 1, wherein the bonus accumulator accumulates the bonus elements based on the wager.

13. The game of claim 12, wherein the bonus accumulator accumulates one bonus element for every predetermined number of wagered credits.

14. A game of chance, comprising a game play engine with a bonus accumulator, the game play engine being iteratively executed in game play cycles in response to respective wagers and, for each game play cycle, randomly selecting an outcome from a plurality of possible outcomes, the bonus accumulator accumulating a number "N" of bonus elements based on predetermined criteria where the number "N" is greater than zero, in response to a demand by the player during any one of the player's multiple game play cycles, the bonus elements being redeemed by the player for an award regardless of the number "N" of bonus elements on the bonus accumulator.

15. A method of executing a game of chance, comprising:

receiving a wager;

executing the game to randomly select an outcome from a plurality of possible outcomes;

accumulating a number "N" of bonus elements in a bonus accumulator of the game based on predetermined criteria, the number "N" being greater than zero; and in response to a demand by a player that is received during any one of the player's multiple game play cycles, permitting the player to redeem the bonus elements for an award during the selected one of the multiple game play cycles regardless of the number "N" of bonus elements, the game play cycle being defined as between the receiving of the wager and a receiving of a succeeding wager triggering another execution of the game.

16. The method of claim 15, wherein the award includes game credits.

17. The method of claim 16, wherein each bonus element is worth one game credit.

18. The method of claim 15, wherein the award includes a game feature.

19. The method of claim 18, wherein the game play engine executes a slot game including a plurality of symbol-bearing reels that are rotated and stopped to place symbols on the reels in visual association with a display area, the game feature being one or more free spins of the reels.

20. The method of claim 19, wherein the number of free spins of the reels is determined by the number "N" of bonus elements redeemed.

21. The method of claim 18, wherein the game feature includes one or more free plays of the game.

22. The method of claim 21, wherein the number of free plays is determined by the number "N" of bonus elements redeemed.

23. The method of claim 18, wherein the game play engine executes a poker game, the game feature being one or more wild cards in the poker game.

24. The method of claim 15, wherein each bonus element has an expected redemption value, the expected redemption value being greater if the number "N" of bonus elements in the bonus accumulator reaches a predetermined threshold.

25. The method of claim 15, wherein the bonus accumulator accumulates the bonus elements based on the selection of a special outcome from the plurality of possible outcomes.

26. The method of claim 15, wherein the bonus accumulator accumulates the bonus elements based on the wager.

27. The method of claim 26, wherein the bonus accumulator accumulates one bonus element for every predetermined number of wagered credits.

* * * * *